United States Patent [19]

Nakamura

[11] Patent Number: 4,773,683

[45] Date of Patent: Sep. 27, 1988

[54] DOOR LOCK DEVICE

[75] Inventor: Hitoshi Nakamura, Yokohama, Japan

[73] Assignee: Ohi Seisakusho Co., Ltd., Yokohama, Japan

[21] Appl. No.: 889,405

[22] Filed: Jul. 25, 1986

[30] Foreign Application Priority Data

Aug. 9, 1985 [JP] Japan ..... 60-174012

[51] Int. Cl.[4] ..... E05C 3/26

[52] U.S. Cl. ..... 292/216; 292/336.3; 292/DIG. 43

[58] Field of Search ..... 292/216, 48, 336.3, 292/DIG. 43

[56] References Cited

U.S. PATENT DOCUMENTS 4,157,844 6/1979 Sarosy et al. ..... 292/DIG. 43 X

FOREIGN PATENT DOCUMENTS 57-191125 11/1983 Japan .

*Primary Examiner*—Richard E. Moore

*Attorney, Agent, or Firm*—Foley & Lardner, Schwartz, Jeffery, Schwaab, Mack, Blumenthal & Evans

[57] ABSTRACT

First, second and third pivotal levers are interconnected through a link mechanism in order to operate a latch mechanism which includes a latch plate and a pawl plate. When the first lever assumes its latch position and the third lever assumes its first angular position, pivoting of the second lever toward its second angular position induces a pivoting movement of the first lever toward its unlatch position thereby to release the latched condition of the latch mechanism. When the first lever assumes its latch position and the third lever assumes either its second or third angular position, pivoting of the second lever toward its second angular position has no effect of the first lever thereby holding the latch mechanism in the latched condition. When the first lever assumes its unlatch position, pivoting of the second lever toward its second angular position has substantially no effect on the first lever irrespective of angular position which the third lever assumes and the third lever is prevented from assuming its third angular position.

16 Claims, 8 Drawing Sheets

DOOR LOCK DEVICE

BACKGROUND OF THE INVENTION

1. Field of the Invention

The present invention relates in general to a lock system for an automotive back door of a type having an auxiliary door hinged thereto, and more particularly to a lock for locking both the back door and the auxiliary door. More specifically, the present invention is concerned with a lock device used as one part of the lock system for locking one of the doors to its associated part.

2. Description of the Prior Art

A so-called "hinged window-mounted hinged door" has been put into practical use as a back door of a delivery van type motor vehicle. The door of this type comprises generally a main door part which is hinged to the vehicle body to open and close a back opening of the vehicle, and an auxiliary door part which is hinged to the main door part to open and close a window opening formed in the main door part. In order to hold these two door parts in their closed positions, various kinds of door lock systems have been hitherer to proposed. One of the lock systems is disclosed in Japanese Patent First Provisional Publication No. 57-191125, which will be outlined in the following in order to clarify the task of the present invention.

Referring to FIG. 16, a so-called "hinged window-mounted door" a is shown as a back door of a delivery van type motor vehicle. The back door a comprises a main door part c hinged at its upper end to a vehicle body b to open and close a back opening of the vehicle, and an auxiliary door part e hinged to the main door part c to open and close a window opening d formed in the same.

In order to releasably hold the main door part c and the auxiliary door part e in their closed positions, first and second lock devices f and g are independently mounted to the back door. Upon request of opening the main door part c, the first lock device f is manipulated to release the main door part c, while, upon request of opening the auxiliary door part e, the second lock device g is manipulated to release the auxiliary door part. That is, in this conventional door lock system, opening operations of the main and auxiliary door parts c and e are independently carried out by respective lock devices f and g.

However, due to the inherent construction, the above-mentioned conventional lock system may induce the following undesirable matters. That is, if, with a baggage h carried on the roof of the vehicle, the main door part c is brought into its open position with the auxiliary door part e opened, it may occur that the auxiliary door part e collides against an edge of the baggage h resulting in breakage of the same. The problems of this type are frequently carried out by absent-minded persons.

In order to solve the above-mentioned problem, there has been also proposed a lock system which is designed to prevent one of the two lock devices from assuming its unlatched condition when the other lock device is in its unlatched condition. With this, there occurs no chance that the two doors are opened at the same.

SUMMARY OF THE INVENTION

It is therefore an essential object of the present invention to provide an improved lock device which is employable as a part of the above-mentioned lock system.

According to the present invention, there is provided a lock device which comprises a case; latching means arranged in the case and having selectively latched and unlatched conditions; a first lever pivotal about a first pivot axis between its latch position taken when the latching means assumes the latched condition and its unlatch position taken when the latching means assumes the unlatched condition; a second lever pivotal about the first pivot axis between its first and second angular positions; a third lever pivotal about a second pivot axis and having its first, second and third angular positions in this order; and link means linking said first, second and third levers in such a manner that when the first lever is in its latch position and the third lever is in its first angular position, pivoting of the second lever from its first angular position to its second angular position induces a pivoting movement of the first lever toward its unlatch position thereby releasing a latched condition of the latching means, and when the first lever is in its latch position and the third lever is in either one of its second and third angular positions, pivoting of the second lever from its first angular position to its second angular position has no effect on the first lever thereby holding the latching means in its latched condition, and when the first lever is in its unlatched position, pivoting of the second lever from its first angular position to its second angular position has substantially no effect on the first lever irrespective of angular positions which the third lever assumes and the third lever is prevented from assuming its third angular position.

DETAILED DESCRIPTION OF THE INVENTION

Prior to describing in detail a lock device of the present invention, a lock system to which the lock device is practically applied will be described in order to clarify the invention.

Referring to FIGS. 1 to 15, there is shown the lock system to which a lock device (or first lock device) of the present invention is applied. As is seen from FIGS. 1 and 2, the lock system is applied to a so-called "hinged window-mounted hinged back door" of a delivery van type motor vehicle.

Figure 1:
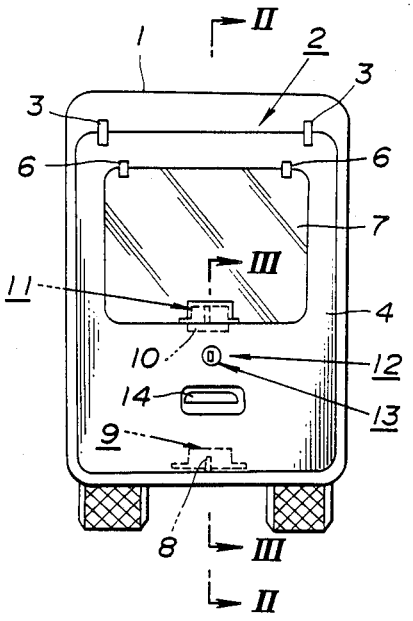
FIG. 1 is a back view of a delivery van type motor vehicle equipped with a "hinged window-mounted hinged back door" to which a lock system is practically applied, the lock system including an improved lock device according to the present invention.
Figure 2:
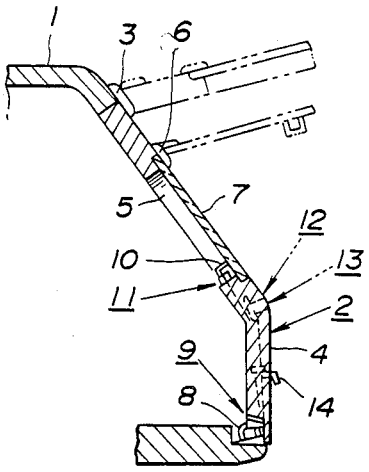
FIG. 2 is a sectional view taken along the line II—II of FIG. 1.

In FIGS. 1 and 2, denoted by numeral 1 is a body of the motor vehicle, which is equipped with the hinged window-mounted back door 2. The door 2 comprises generally a main door part 4 which is pivotally connected at its upper portion to a back-upper portion of the body 1 through two spaced hinges 3 and 3 so as to close and open a back door opening of the body 1, and an auxiliary door part (or window pane) 7 which is pivotally connected at its upper portion to the main door part 4 through two spaced hinges 6 and 6 so as to close and open a rectangular window opening 5 formed in the main door part 4.

Denoted by numeral 8 (see FIG. 3) is a generally U-shaped striker which is secured to a middle portion of a rear edge of the vehicle floor, and denoted by numeral 9 is a first lock device of the present invention which is mounted to a middle portion of a lower edge of the main door part 4. Upon closing of the main door part 4, the first lock device 9 lockably catches the striker 8 to latch the main door part 4 to the vehicle body 1.

Denoted by numeral 10 (see FIG. 3) is another generally U-shaped striker which is secured to a lower portion of the auxiliary door part 7, and denoted by numeral 11 is a second lock device which is mounted to a lower edge portion of the window opening 5. Upon closing of the auxiliary door part 7, the second lock device 11 lockably catches the striker 10 to latch the auxiliary door part 7 to the main door part 4.

Denoted by numeral 12 (see FIG. 3) is a control device which, as will be described hereinafter, is linked to both the first and second lock devices 9 and 11 so as to "selectively" release latched conditions of the first and second lock devices 9 and 11. The control device 12 comprises a key cylinder device 13 mounted to the main door part 4, as is seen from FIG. 3.

Denoted by numeral 14 (see FIG. 3) is a handle pivotally mounted to the main door part 4 and linked to the first lock device 9 in an after-mentioned manner.

As will be described hereinafter, upon releasing the second lock device 11 with operation of the control device 12, the auxiliary door part 7 becomes ready for opening. However, in the main door part 4, the opening operation of the same is effected only when the handle 14 is pulled after releasing the first lock device 9 by the control device 12.

In the following, construction of each part will be described with reference to FIG. 3.

The key cylinder device 13 of the control device 12 is of a conventional type which thus comprises a key cylinder 15 secured to the main door part 4 and a key rotor 17 (see FIG. 4) rotatably received in the key cylinder 15. The key rotor 17 has a key hole 16 formed therein for receiving a key (not shown) as is understood from FIG. 4.

Figure 3:
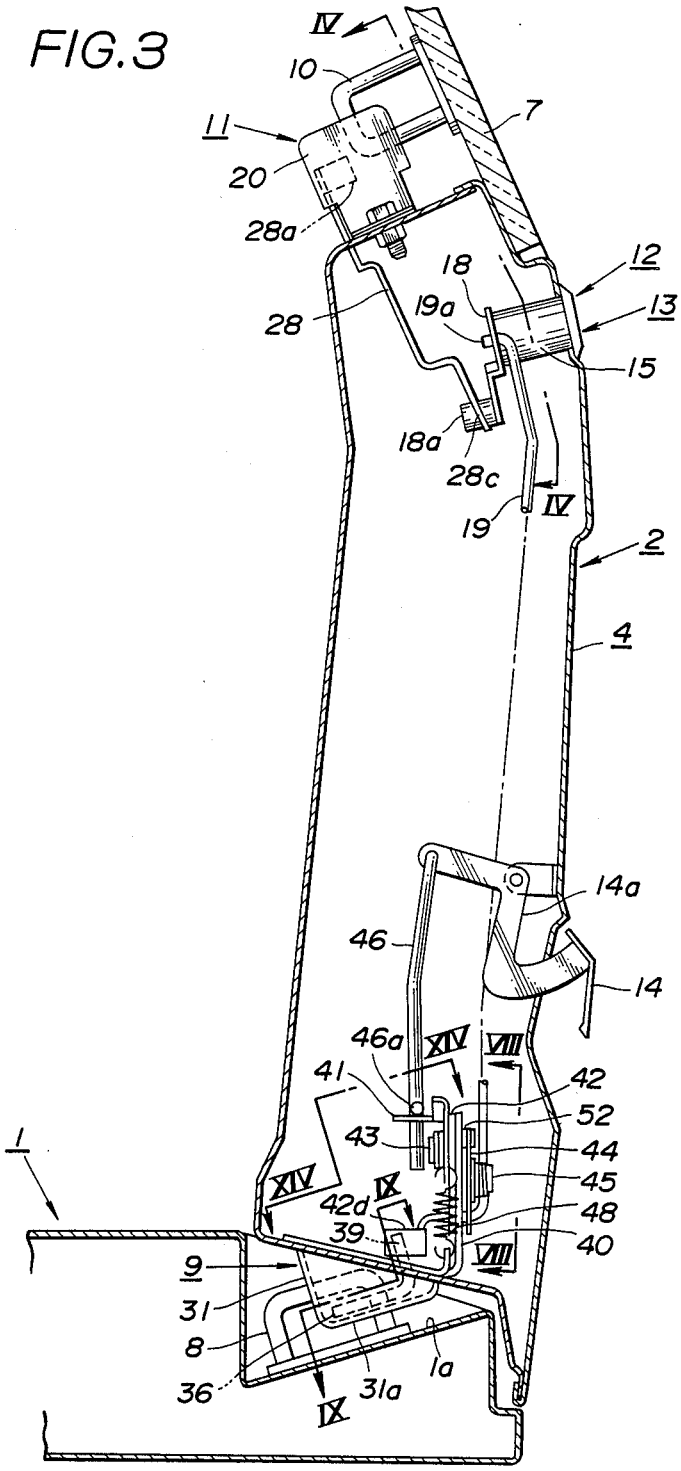
FIG. 3 is an enlarged sectional view taken along the line III—III of FIG. 1.
Figure 4:
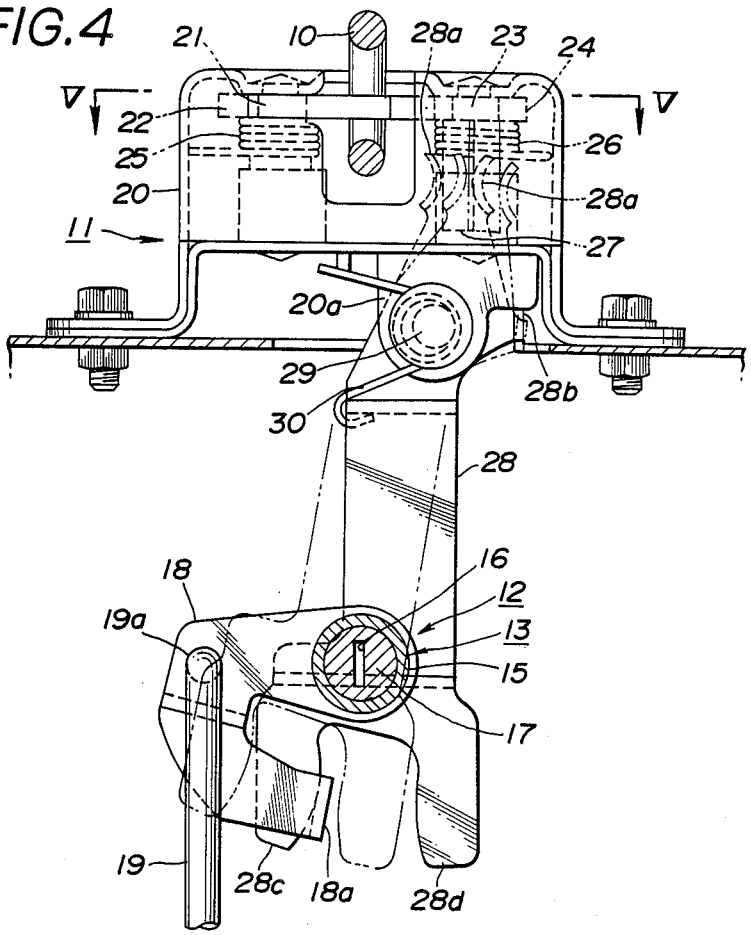
FIG. 4 is an enlarged sectional view taken along the line IV—IV of FIG. 3, showing a control device and a second lock device which are operatively connected with each other.

As is seen from FIGS. 3 and 4, a generally U-shaped key plate 18 is secured to an inboard end of the key rotor 17 to rotate therewith. By manipulating a key (not shown) in the key rotor 17, the key plate 18 is rotated, together with the key rotor 17, from its neutral position as shown in FIG. 4 to either a second lock releasing position "S" as shown in FIG. 6 or a first lock releasing position "F" as shown in FIG. 7.

Figure 6:
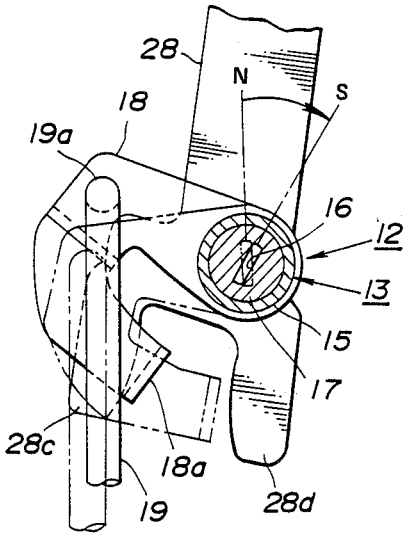
FIG. 6 is a sectional view of the control device in a condition wherein a key rotor of the control device has been turned from a neutral position as illustrated by a phantom line to a second lock releasing position as illustrated by a solid line.
Figure 7:
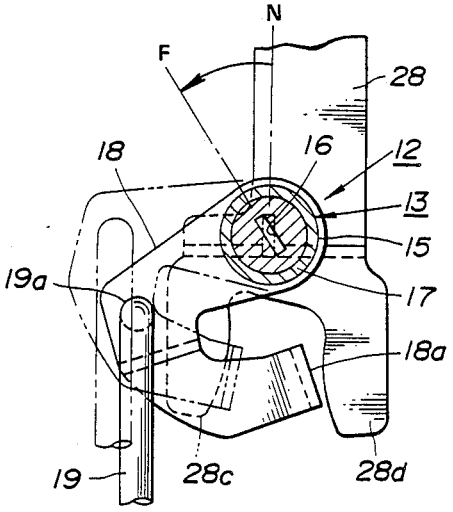
FIG. 7 is a view similar to FIG. 6, but showing a condition wherein the key rotor of the control device has been turned from the neutral position as illustrated by a phantom line to a first lock releasing position as illustrated by a solid line.

As may be understood from FIGS. 6 and 7, the key rotor 17 assumes respective angular positions thereof corresponding to those of the key plate 18 as is understood from the positions of the key hole 16.

As is seen from FIG. 4, the key plate 18 has at its leading end a lug 18*a* bent toward the other side with respect to the surface of the drawing. The bottom portion of the U-shaped key plate 18 is formed with an opening (no numeral) with which a bent upper end 19*a* of a rod 19 is pivotally engaged. As will be described hereinafter, the rod 19 leads to the first lock device 9 to operate the same.

Figure 5:
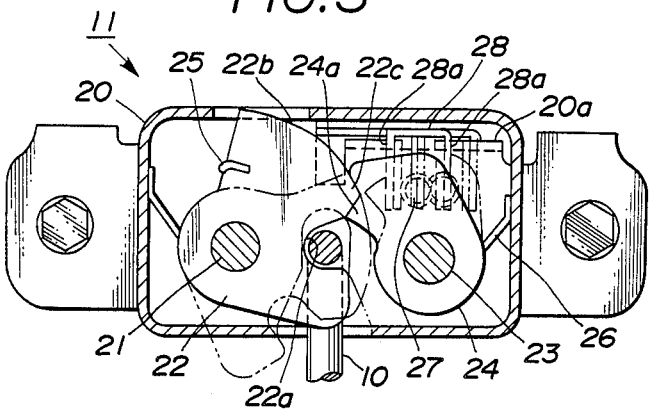
FIG. 5 is a sectional view taken along the line V—V of FIG. 4.

As is seen from FIGS. 3 to 5, the second lock device 11 comprises a case 20 secured to the main door part 4, a latch plate 22 pivotally disposed about a pivot shaft 21 secured to the case 20, and a pawl plate 24 pivotally disposed about another pivot shaft 23 which is parallel with the shaft 21 and secured to the case 20.

As is illustrated by a phantom line in FIG. 5, the latch plate 22 assumes its unlatched position when the second lock device 11 releases the striker 10 of the auxiliary door part 7, that is, when the auxiliary door part 7 is opened. While, when the striker 10 comes into engagement with the second lock device 11, the latch plate 22 is turned to its latched position as illustrated by a solid line to latch the striker 10. Under this latched condition, a recess 22*a* formed in the latch plate 22 tightly catches a portion of the striker 10.

As is illustrated by a phantom line in FIG. 5, the pawl plate 24 assumes its latch releasing position when the latch plate 22 assumes the unlatched position (as illustrated by a phantom line), that is, when the auxiliary door part 7 is opened. Under this latch releasing condition of the pawl plate 24, an engaging portion 24*a* formed on the pawl plate 24 is put on an arcuate edge 22*b* of the latch plate 22. The arcuate edge 22*b* is concentric with the pivot shaft 21. When the latch plate 22 assumes the latched position (as illustrated by a solid line), that is, when the striker 10 of the auxiliary door part 7 is caught by the second lock device 11, the engaging portion 24*a* of the pawl plate 24 is lockingly engaged with an angled portion 22c of the latch plate 22. The angled portion 22c is defined between the arcuate edge 22b and the recess 22a. Thus, under this latched condition, rotation of the latch plate 22 toward its unlatched position is blocked by the pawl plate 24.

As is seen from FIGS. 4 and 5, a coil spring 25 is disposed about the pivot shaft 21 with one end (no numeral) hooked to the latch plate 22 (see FIG. 5) and the other end (no numeral) hooked to the case 20 (see FIG. 4), so that the latch plate 22 is biased in a clockwise direction in FIG. 5, that is, toward its unlatched position. Another coil spring 26 is disposed about the pivot shaft 23 of the pawl plate 24 (see FIG. 4) with one end hooked to a stud 27 of the pawl plate 24 and the other end hooked to the case 20 (see FIG. 6), so that the pawl plate 24 is biased in a counter-clockwise direction in FIG. 5, that is, toward the latch position of the pawl plate 24. As is understood from FIG. 4, the stud 27 extends perpendicular from the pawl plate 24 downward in this drawing.

As is seen from FIG. 4, a bracket 20a extends downward from the bottom portion of the case 20, which has a pivot pin 29 secured thereto. A pivotal lever 28 is supported by the pivot pin 29 so as to be pivotal about the axis of the pin. The upper portion of the pivotal lever 28 is projected into the case 20 passing through an opening (no numeral) formed in the bottom of the case 20. The upper portion of the pivotal lever 28 is formed with a pair of lugs 28a between which the stud 27 is put, so that a pivotal movement of the lever 28 about the pivot pin 29 induces a pivotal movement of the pawl plate 24 about the pivot pin 23.

That is, when the pawl plate 24 assumes its latch position (as illustrated by a solid line in FIG. 5), the pivotal lever 28 assumes its latch position as illustrated by a solid line in FIG. 4, and when the pawl plate 24 assumes its latch releasing position (as illustrated by a phantom line in FIG. 5), the pivotal lever 28 assumes its latch releasing position as illustrated by a phantom line in FIG. 4.

As may be seen from FIG. 4, the paired lugs 28a have mutually facing convex portions. With this construction, the movement transmission from the lever 28 to the pawl plate 24 is smoothly made. The pivotal lever 28 is formed near the pivot pin 29 with a stopper lug 28b which is brought into abutment with a lug 20b of the bracket 20a when the lever 28 is pivoted to its latch position as illustrated by the solid line in FIG. 4. With this, extreme counterclockwise rotation of the lever 28 is suppressed. A coil spring 30 is disposed about the pivot pin 29 with one end hooked to the bottom of the case 20 and the other end hooked to the lever 28, so that the pivotal lever 28 is biased in a counterclockwise direction in FIG. 4, that is, toward its latch position.

The pivotal lever 28 is formed with a forked lower end including two spaced leg portions 28c and 28d which put therebetween the lug 18a of the aforementioned generally U-shaped key plate 18, as may be understood from FIG. 3.

The positional relationship between the forked lower end of the pivotal lever 28 and the lug 18a of the key plate 18 is made in the following manner.

That is, when, as is understood from FIG. 4, the lever 28 assumes its latch position as illustrated by a solid line, one or left leg portion 28c thereof contacts or at least lies near the lug 18a of the key plate 18 which is in its neutral position. Thus, when, under this condition, the key plate 18 is turned to the second lock releasing position (as illustrated by a solid line in FIG. 6) due to rotation of the key rotor 17, the lug 18a of the key plate 18 pushes the leg portion 28c of the lever 28 in a clockwise direction in FIG. 4 and brings the same to the latch releasing position of the lever 28, as is illustrated by a phantom line in FIG. 4. As will be understood hereinafter, when the pivotal lever 28 is brought to its latch releasing position (as illustrated by a phantom line in FIG. 4) and external force applied to the leg portion 28c is thereafter removed, the lever 28 is returned back but slightly due to the force of the coil spring 30 and stopped at its halfway position where the other (or right) leg portion 28d of the lever 28 lies close to the lug 18a of the key plate 18 which is in its neutral position. Under this condition, the pivotal lever 28 is prevented from pivoting in a counterclockwise direction in FIG. 4, that is, toward its latch position illustrated by the solid line, so that rotation of the key plate 18 toward its first lock releasing position is blocked due to the interruption of the other leg portion 28d.

However, when the pivotal lever 28 is in its latch position as illustrated by a solid line in FIG. 4, the key plate 18 can swing between its neutral position and the first lock releasing position because the lug 18a of the key plate 18 can freely move between the two leg portions 28c and 28d.

Accordingly, when a key (not shown) is inserted into the key hole 16 of the key rotor 7 and turned in a direction to turn the key plate 18 from its neutral position to the second lock releasing position (as illustrated by the solid line in FIG. 6), the lever 28 and the pawl plate 24 are turned to their latch releasing positions thus releasing the latch plate 22. With this, the striker 10 of the auxiliary door part 7 is released from the second lock device 11, so that the auxiliary door part 7 can be opened. Upon this, the engaging portion 24a of the pawl plate 24 rides on the arcuate edge 22b of the latch plate 22, so that the pawl plate 24 and the pivotal lever 28 are kept in their latch releasing positions. Thus, thereafter, the key plate 18 of the key cylinder 13 is prevented from turning from its neutral position to its first lock releasing position.

Accordingly, when the auxiliary door part 7 is kept opened, releasement of the first lock device 9 by manipulating the control device 12 is impossible. This is quite advantageous when considering the danger which would arise when the main door part 4 becomes opened with the auxiliary door part 7 opened.

When the auxiliary door part 7 is closed, the striker 10 of the part 7 is brought into engagement with the latch plate 22 and pushes the same. With this, the latch plate 22 is turned to its latched position permitting the engaging portion 24a of the pawl plate to come into locking engagement with the angled portion 22c thereof. With this, the pawl plate 24 and the lever 28 are both turned to their latch positions by the forces of the springs 26 and 30. Thereafter, the key plate 18 of the control device 12 can be turned in the other direction to release the first lock device 9 to allow the main door part 4 to open in such a manner as will be described in the following.

In the following, the first lock device 9 of the present invention will be described in detail with reference to FIGS. 8 to 15.

The first lock device 9 comprises a case 31 secured to a lower edge portion of the main door part 4 in a manner to project outwardly (see FIG. 3). As is seen from FIG. 3, the case 31 has a bottom portion 31a inclined with respect to the lower edge portion, and the case 31 further has a slot 32 into which the afore-mentioned striker 8 is insertable to accomplish latching of the main door part 4 relative to the body 1 of the motor vehicle. As is seen from FIG. 9, a latch plate 34 and a pawl plate 36 are housed in the case 31 and operate in substantially the same manner as that in the second lock device 11. These latch plate 34 and pawl plate 36 are pivotally disposed about respective pivot pins 33 and 35 which are secured to the bottom portion 31*a* of the case 31.

As is seen from FIG. 3, the striker 8 is secured to an inclined surface 1*a* of the rear edge of the vehicle floor. The inclined surface 1*a* and the inclined bottom surface 31*a* of the case 31 are so arranged that upon closing of the main door part 4, they become parallel with each other.

Figure 9:
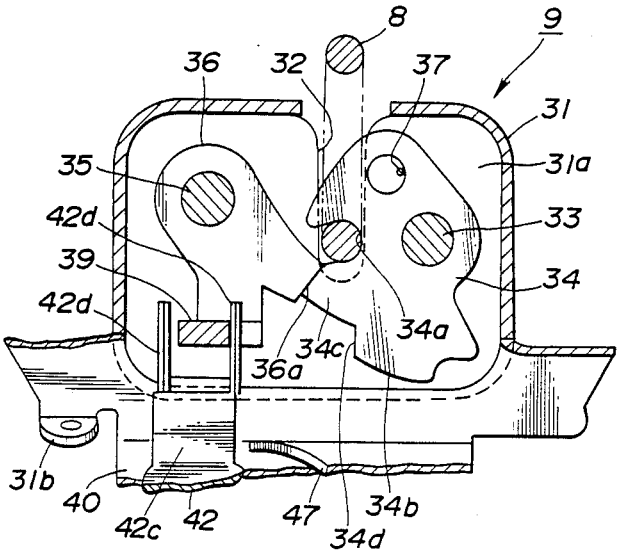
FIG. 9 is an enlarged sectional view taken along the line IX—IX of FIG. 3, showing partially the first lock device in latched condition.
Figure 11:
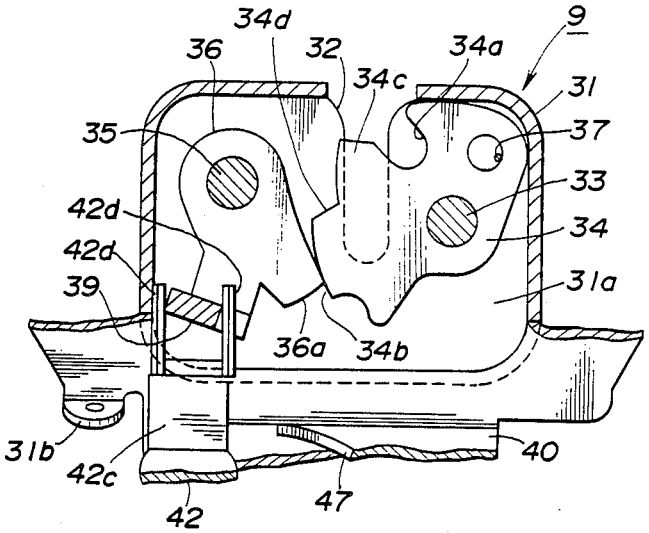
FIG. 11 is a view similar to FIG. 9, but showing a condition wherein the first lock device is in its unlatched condition.

As is seen from FIG. 11, the latch plate 34 assumes its unlatched position when the first lock device 9 releases the striker 8 of the vehicle body, that is, when the main door part 4 is opened. While, when the striker 8 comes into engagement with the first lock device 9, that is, when the main door part 4 is brought into its closed position to latch plate 34 is turned to its latched position to latch the striker 8 as is shown in FIG. 9. Under this latched condition, a recess 34*a* formed in the latch plate 34 receives the striker 8.

When the latch plate 34 is in its unlatched position (as shown in FIG. 11), that is, when the main door part 4 is opened, the pawl plate 36 assumes its latch releasing position with an engaging portion 36*a* thereof being in contact with an arcuate edge 34*b* of the latch plate 34. The arcuate edge 34*b* is concentric with the pivot pin 33. When, as is seen from FIG. 9, the main door part 4 is closed and thus the latch plate 34 is turned to its latched position by the striker 8, the engaging portion 36*a* of the pawl plate 36 comes into locking engagement with an angled portion 34*c* of the same which is defined between the arcuate edge 34*b* and the recess 34*a*. Thus, under this condition, rotation of the latch plate 34 toward its unlatched position is blocked by the pawl plate 36. The latch plate 34 can assume a half-latched position wherein the engaging portion 36*a* of the pawl plate 36 is received in a recess 34*d* formed in the latch plate 34 at a position between the angled portion 34*c* and the arcuate edge 34*b* of the latch plate 34.

Figure 14:
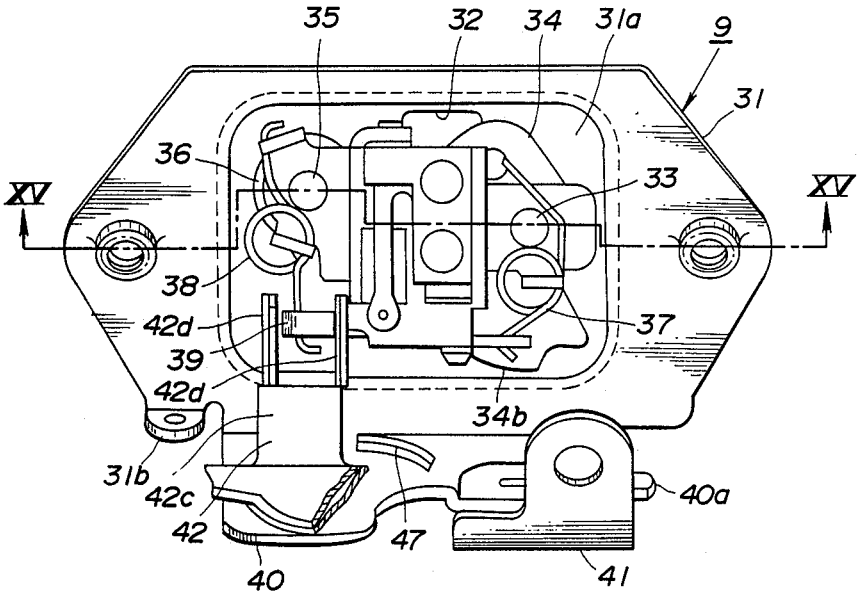
FIG. 14 is an enlarged view taken from the direction of the arrow XIV—XIV of FIG. 3.
Figure 15:
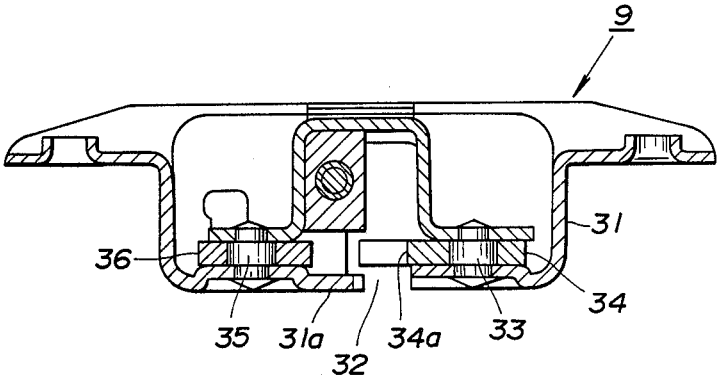
FIG. 15 is a sectional view taken along the line XV—XV of FIG. 14.
Figure 16:
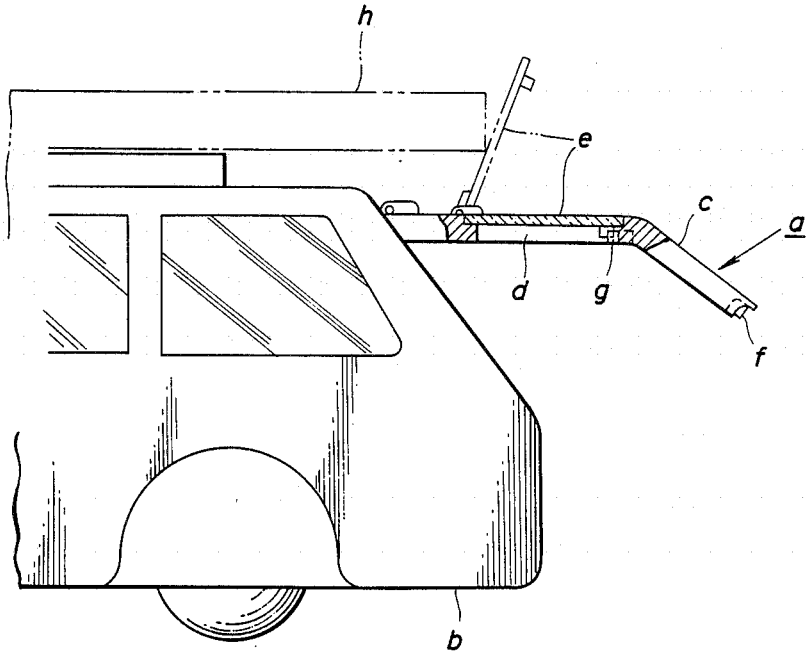
FIG. 16 is a side view of a delivery van type motor vehicle equipped with a conventional lock system for a hinged back door.

As is seen from FIG. 14, a coil spring 37 is arranged in the case 31 in a manner to bias the latch plate 34 toward its unlatched position, that is, in a clockwise direction in FIGS. 9 and 11. Another coil spring 38 (see FIG. 14) is arranged in the case 31 in a manner to bias the pawl plate 36 toward its latch position, that is, in a counterclockwise direction in FIGS. 9 and 11. The pawl plate 36 is formed with a stud 39 which extends toward this side in FIG. 14.

The case 31 is formed with an outwardly extending back plate 40. As is seen from FIG. 8, a pivot shaft 43 is fixed to the back plate 40 to pivotally support a handle lever 41 and an open lever 42. It is to be noted that the open lever 42 and the handle lever 41 are arranged in this order at an inboard side (viz., the side facing toward the case proper 31) of the back plate 40. A locking-unlocking lever 44 is pivotally connected to the outboard side of the back plate 40 through a pivot pin 45.

Figure 8:
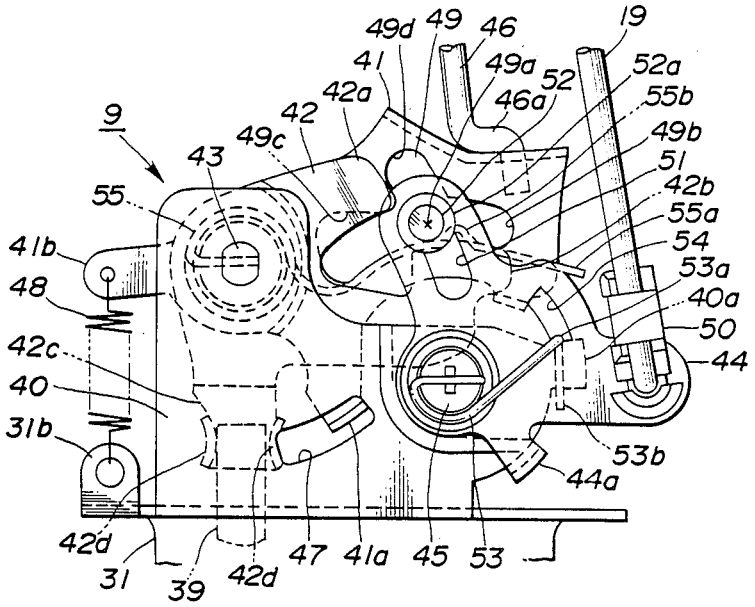
FIG. 8 is an enlarged back view taken from the direction of the arrow of VIII—VIII of FIG. 3, showing partially a first lock device of the present invention.

As is seen from FIG. 8, an upper portion of the handle lever 41 is bent at normal to which a crank end portion 46*a* of a rod 46 is pivotally connected. As is understood from FIG. 3, the rod 46 extends upwardly to a pivotal arm member 14*a* of the handle 14, so that when the handle 14 is pulled to pivot the arm member 14*a* in a counterclockwise direction in FIG. 3, the rod 46 is moved downward thereby to pivot the handle lever 41 about the pivot shaft 42 in a clockwise direction in FIG. 8 from its inoperative position as shown in the drawing. A coil spring 48 is arranged between an arm 41*b* of the handle lever 41 and a lug 31*b* of the case 31 to bias the handle lever 41 toward its inoperative position, that is, in a counterclockwise direction in FIG. 8 about the pivot shaft 43.

The back plate 40 is formed with an arcuate slot 47 which is concentric with the pivot shaft 43 and into which a bent end 41*a* of another arm (no numeral) of the handle lever 41 is spacedly received. As the bent end 41*a* is selectively engageable with longitudinal ends of the arcuate slot 47, the angle of rotation of the handle lever 41 is limited.

The handle lever 41 is formed with a generally T-shaped slot 49. The slot 49 consists of a first arcuate section 49*b*, a sectoral section 49*c* and a second arcuate section 49*d* which are merged to form the generally T-shaped slot 49. It is to be noted that the mark "x" denoted by numeral 49*a* in FIG. 8 is an intermediate or neutral position of the T-shaped slot 49 at which an after-mentioned pin 52 lies when the same assumes its neutral position. As will be understood from FIG. 8, the lower sides of the first arcuate section 49*b* and the sectoral section 49*c* form a common arcuate line which is, when the parts assume the illustrated positions, concentric with the pivot pin 45. The second arcuate section 49*d* is formed to be concentric with the pivot shaft 43.

The open lever 42 placed beneath the handle lever 41 comprises first, second and third arms 42*a*, 42*b* and 42*c* which are spaced from one another. Under the condition as illustrated in FIG. 8, the first arm 42*a* extends in the upper-right direction, the second arm 42*b* extends in the rightward direction and the third arm 42*c* extends downward.

The lower end portion of the third arm 42*c* is cranked and formed with a pair of spaced lugs 42*d* between which the afore-mentioned pin 39 of the pawl plate 36 is put to make an articulated connection therewith. Due to this connection between the pin 39 and the lugs 42*d*, the open lever 42 is moved together with the pawl plate 36, like in the case of the connection between the pivotal lever 28 and the pawl plate 24 of the afore-described second lock device 11.

That is, the open lever 42 assumes its latch position as shown in FIG. 8 when the pawl plate 36 assumes its latch position as shown in FIG. 9. While, when the pawl plate 36 is turned to its latch releasing position as shown in FIG. 11, the open lever 42 is brought into its latch releasing position.

When the open lever 42 assumes its latch position (as shown in FIG. 8), a leading end (or stopper end) of the first arm 42*a* disappears from the T-shaped slot 49 and a leading end of the second arm 42*b* becomes flush with the lower side of the first arcuate section 49*b* of the slot 49. When, then, the open lever 42 is turned to its latch releasing position (as shown in FIG. 10), the leading end of the first arm 42*a* becomes exposed to the sectoral section 49*c* thereby to block an after-mentioned slide pin 52 from moving into the sectoral section 49*c* of the slot 49, and the leading end of the second arm 42*b* is left away from the lower side of the first arcuate section 49*b* of the slot 49.

As is seen from FIG. 8, to the right end of the locking-unlocking lever 44, there is connected through a known rod holder 50 a lower end of the rod 19 which leads to the afore-mentioned key plate 18 of the control device 12. With this rod 19, the locking-unlocking lever 44 and the key plate 18 move together.

Figure 10:
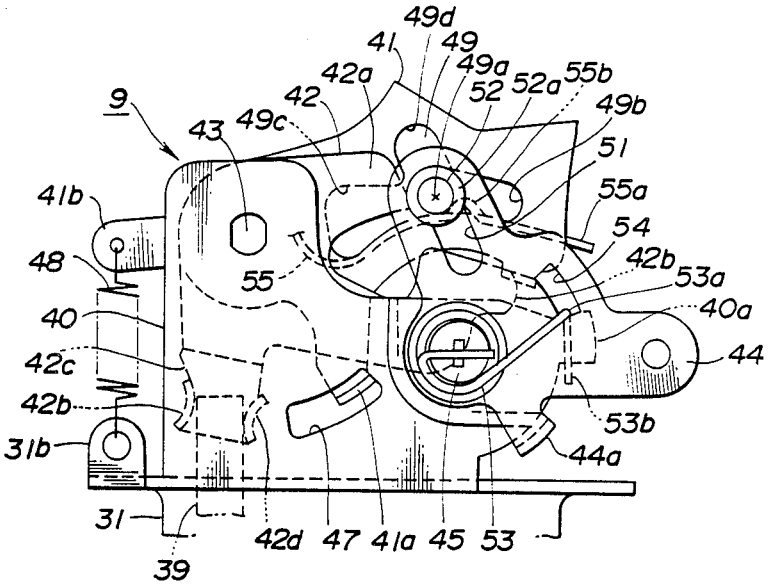
FIG. 10 is a view similar to FIG. 8, but showing a condition wherein an open lever of the first lock device has been turned to its latch releasing position.
Figure 12:
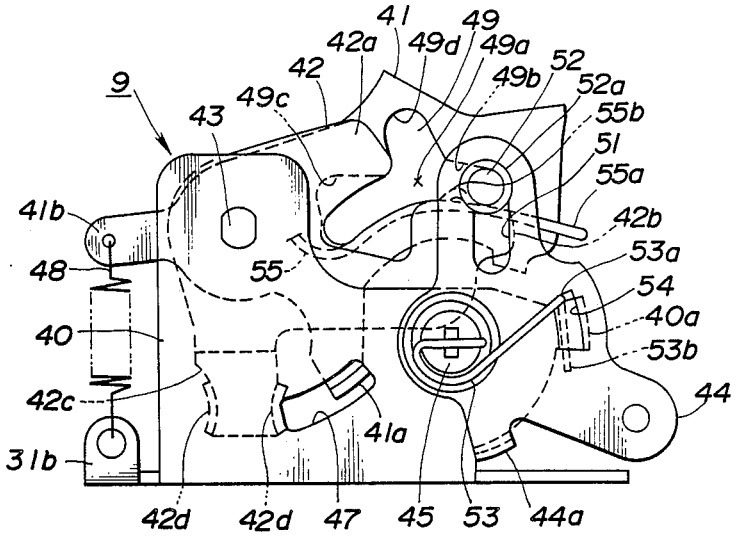
FIG. 12 is a view similar to FIG. 8, but showing a condition wherein a locking-unlocking lever of the first lock device has been turned to its unlatched position.
Figure 13:
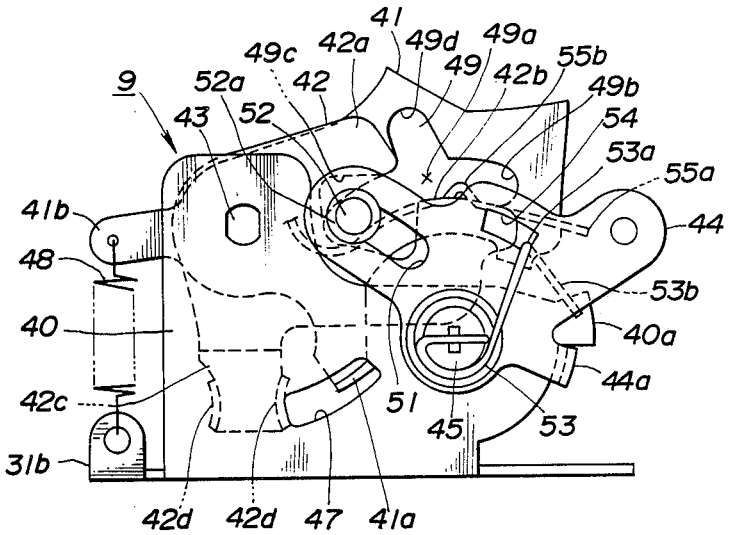
FIG. 13 is a view similar to FIG. 8, but showing a condition wherein the locking-unlocking lever has been turned to a second lock releasing position.

That is, the locking-unlocking lever 44 assumes its lock position as shown in FIGS. 8 and 10 when the key plate 18 assumes its neutral position. When the key plate 18 is turned to the first lock releasing position (as illustrated by a solid line in FIG. 7), the locking-unlocking lever 44 is turned to its unlock position as shown in FIG. 12. While, when the key plate 18 is turned to its second lock releasing position (as illustrated by a solid line in FIG. 6), the locking-unlocking lever 44 is turned to its second lock releasing position as shown in FIG. 13.

The locking-unlocking lever 44 is formed, at a portion above the pivot pin 45, with an arcuate slot 51. The arcuate slot 51 is so formed that when the locking-unlocking lever 44 assumes its unlock position as shown in FIG. 12, it is concentric with the pivot shaft 43.

The slide pin 52 is slidably received at its one end in the arcuate slot 51 having the other end slidably received in the generally T-shaped slot 49. In order to slidably support the slide pin 52 on the locking-unlocking lever 44 keeping the same perpendicular to the surface of the lever 44, a pair of collars **52*a* are secured to the pin 52 putting therebetween the peripheral edge of the arcuate slot 51** slidably.

As has been just mentioned, the other end of the slide pin 52 is slidably received in the T-shaped slot 49 of the handle lever 41. Arrangement is so made that when the locking-unlocking lever 44 is in its lock position (as shown in FIGS. 8 and 10), the slide pin 52 is placed at the intermediate position **49*a* of the slot 49, while, when the locking-unlocking lever 44 assumes its unlock position (as shown in FIG. 12), the slide pin 52 is received in the first arcuate section 49*b*, and when the lever 44 assumes the second lock releasing position (as shown in FIG. 13), the slide pin 52 is received in the sectoral section 49*c***.

The locking-unlocking lever 44 is formed with a lug **44*a* the leading end of which is bent to serve as a stopper. When the lever 44 comes to its unlock position as shown in FIG. 12, the stopper lug 44*a* comes to contact with an edge (no numeral) of the back plate 40, and when the lever 44 comes to the second lock releasing position as shown in FIG. 13, the stopper lug 44*a* comes to contact with a projection 40*a* of the back plate 40. With this, the angle of rotation of the locking-unlocking lever 44** is limited.

A coil spring 53 is disposed about an outwardly projected portion of the pivot pin 45, which functions to bias the locking-unlocking lever 44 toward its lock position when the same is in the second lock releasing position. For achieving this function, an end portion of the spring 53 is fixed to the pivot shaft 45 and the other end portion of the same is bent to pass through an arcuate slot 54 formed in the locking-unlocking lever 44 and put on the projection **40*a* of the back plate 40. The other end portion is bent again at the projection 40*a* to extend along the inside surface of the back plate 40 and terminates at 53*b*. As may be seen from FIG. 8, the arcuate slot 54 is concentric with the pivot pin 45**.

A hair-pin like spring 55 is arranged to bias the slide pin 52 upwardly in FIG. 8, that is, in a direction away from the pivot shaft 45. The spring 55 has a multi-turned section disposed about the pivot shaft 43 and a hair-pin like section **55*a* abutting against the slide pin 52. The hair-pin like section 55*a* is formed with a raised portion 55*b* at its generally middle portion. With the provision of the raised portion 55*b*, a so-called "detent feeling" is produced when the slide pin 52 rides over the same. That is, the detent feeling is given when the slide pin 52 is moved in the slot 49 from the intermediate position 49*a* to the first arcuate section 49*b*** and vice versa.

When the key plate 18 is in its neutral position (as shown in FIG. 4), the locking-unlocking lever 44 assumes its lock position (as shown in FIGS. 8 and 10) wherein the slide pin 52 is in the intermediate position **49*a* of the slot 49. Under this condition, the handle lever 41 can pivot downward in FIG. 8 permitting the slide pin 52 to enter the second arcuate section 49*d* of the slot 49. This pivot movement of the handle lever 41 does not induce any effective movement of other parts. Thus, even when the handle 14 (see FIG. 13) is pulled to pivot the handle lever 41 clockwise in FIG. 8, the latched condition of the first lock device 9** is not released.

When now, due to key operation, the key plate 18 is turned to the first lock releasing position (as shown in FIG. 7) thereby to rotate the locking-unlocking lever 44 to its unlock position (as shown in FIG. 12) and thereafter the handle 14 is pulled, the clockwise movement of the handle lever 41 thus caused pushes the slide pin 52 downward in the arcuate slot 51 in FIG. 12 and thus pushes downwardly the leading end of the second arm **42*b* of the open lever 42 via the slide pin 52. With this, the open lever 42 is turned clockwise causing third arm 42*c* thereof to turn, through the stud 39, the pawl plate 36 (see FIG. 11) to the latch releasing position. Thus, the latch plate 34 is turned to its unlatched position cancelling the latched condition of the first lock device 9. Thus, the main door part 4** can be opened.

When the latched condition of the first lock device 9 is cancelled in a manner as is described hereinabove, the engaging portion **36*a* of the pawl plate 36 rides on the arcuate edge 34*b* of the latch plate 34 causing the pawl plate 36 and the open lever 42 to assume their latch releasing positions. Upon this, the leading end of the first arm 42*a* of the open lever 42 is exposed to the sectoral section 49*c* of the slot 49. Thus, thereafter, the slide pin 52 moved with the locking-unlocking lever 44 is prevented from entering the sectoral section 49*c* of the slot 49. That is, once the first lock device 9 releases the main door part 4 in a manner as is described hereinabove, the locking-unlocking lever 44 and the key plate 18 linked to the lever 44** are prevented from turning to their second lock releasing positions.

Thus, when the main door part 4 is kept open, it is impossible to open the auxiliary door part 7 by manipulating the key cylinder 13 of the control device 12. This is very advantageous when considering the danger which would arise when the auxiliary door part 7 is suddenly opened when the main door part 4 is kept opened.

When, now, the main door part 4 is closed, the latch plate 34 is turned to its latched position and the pawl plate 36 and the open lever 42 are turned to their latch positions due to attack of the striker 8. Upon this, the leading or stopper end of the first arm **42*a* of the open lever 42 disappears from the slot 49. Thus, thereafter, the slide pin 52 moved with the locking-unlocking lever 44 can move into the sectoral section 49*c* of the slot 49. Thus, under this condition, the key plate 18 of the key cylinder 13 can be turned to its second lock releasing position releasing the second lock device 11. Thus, the axuiliary door part 7** can be opened.

What is claimed is:

1. A lock device comprising:

a case;

latching means arranged in said case and having selectively latched and unlatched conditions;

a first lever pivotal about a first pivot axis between its latch position taken when said latching means assumes said latched condition and its unlatched position taken when said latching means assumes said unlatched condition;

a second lever pivotal about said first pivot axis between its first and second angular positions;

a third lever piotal about a second pivot axis and having its first, second and third angular positions in this order; and link means comprising:

first, second and third arms formed on said first lever, said first arm being linked to said latching means, said second arm having at its leading end a driven end and said third arm having at its leading end a stopper end;

means defining in said second lever a generally T-shaped slot which consists of a first arcuate section, a sectoral section and a second arcuate section which are merged to form the generally T-shaped slot, said first and sectoral sections having a common arcuate edge which becomes concentric with said second pivot axis when said second lever assumes its first angular position, said second arcuate section being concentric with said first pivot axis; and a slide pin slidably received in said T-shaped slot of said second lever with its one end slidably held in an arcuate guide slot formed in said third lever, said guide slot becoming concentric with said first pivot axis when said third lever assumes its first angular position, wherein when said first lever assumes its latch position, said driven end of said second arm comes to a position near said first arcuate section of the T-shaped slot, and wherein when said first lever assumes its unlatch position, the stopper end of said third arm is exposed to said sectoral section of the T-shaped slot to contact said sectoral section so that when said first lever is in its latch position and said third lever is in its first angular position, pivoting of said second lever from its first angular position to its second angular position induces a pivoting movement of said first lever toward its unlatch position thereby releasing a latched condition of said latching means, and when said first lever is in its latch position and said third lever is in either one of its second and third angular positions, pivoting of said second lever from its first angular position to its second angular position has no effect on said first lever thereby holding said latching means in its latched condition, and when said first lever is in its unlatch position, pivoting of said second lever from its first angular position to its second angular position has substantially no effect on said first lever irrespective of angular positions which said third lever assumes and said third lever is prevented from assuming its third angular position.

2. A lock device as claimed in claim 1, in which said second lever is biased by a spring in a direction from its second angular position toward its first angular position, and in which said third lever is biased by another spring in a direction from its third angular position to its second angular position.

3. A lock device as claimed in claim 2, further comprising a detent feeling producing means which produces a detent feeling when said third lever is turned from its first angular position to its second angular position and vice versa.

4. A lock device as claimed in claim 3, in which said detent feeling producing means comprising a hair pin like spring which is arranged to contact with said slide pin to bias the same in one direction, said hair pin like spring having a raised portion over which said slide pin ridges when said detent feeling is produced.

5. A lock device as claimed in claim 4, in which said first arm of said first lever is formed at its leading end with spaced lugs between which a stud extending from said latching means is put to provide an articulated connection therebetween.

6. A lock device as claimed in claim 5, in which said slide pin has at its one end spaced collars between which the peripheral edge of the arcuate slot of said third lever is slidably received.

7. A lock device as claimed in claim 6, in which said first, second and third levers are pivotally mounted to a back plate which extends from said case.

8. A lock device as claimed in claim 7, in which said back plate is formed with an arcuate slot which is concentric with said first pivot axis, and into which a bent end of said second lever is received thereby to limit the pivotal movement of said second lever relative to said back plate.

9. A lock device as claimed in claim 8, in which the spring for biasing said third lever has one end secured to a pivot shaft about which said third lever is pivotally disposed, an intermediate portion passing through an arcuate slot formed in said third lever and the other end put on a projection formed on said back plate, said arcuate slot being concentric with said pivot shaft which has said second pivot axis passing therethrough.

10. A lock device as claimed in claim 1, in which said latching means further comprises a striker member, a latch plate and a pawl plate wherein said latch and pawl plates latch the striker member when assuming their latched positions and release the striker member when assuming their unlatched positions.

11. A lock device as claimed in claim 10, in which said latch and pawl plates are pivotally disposed about respective pivot shafts which are parallel with each other and secured to said case.

12. A lock device as claimed in claim 11, in which said latch plate is formed with a recess into which said striker member is received when said latch plate assumes its latched position, and in which said pawl plate is formed with an engaging portion which is, upon assuming its latched position, brought into engagement with an angled portion of said latch plate thereby to block said latch plate from turning toward its unlatched position.

13. A lock device as claimed in claim 12, in which said pawl plate is formed with a perpendicularly extending stud which is connected to said first lever in an articulated manner so as to obtain simultaneous pivotal movements of said pawl plate and said first lever.

14. A lock device as claimed in claim 13, in which said latch plate is biased by a spring toward its unlatched position, and in which said pawl plate is biased by another spring toward its latched position.

15. A lock device as claimed in claim 14, in which said latch plate is formed with an arcuate edge which is concentric with the pivot shaft of said latch plate, said arcuate edge carrying thereon said engaging portion of said pawl plate when said latch and pawl plates assume their unlatched positions.

16. A lock device as claimed in claim 15, in which said latch plate can assume a half-latched position wherein said engaging portion of said pawl plate is received in a recess which is formed in said latch plate at a position between said angled portion of said latch plate and said arcuate edge of said latch plate.

* * * * *